US006247691B1

(12) United States Patent
Drago et al.

(10) Patent No.: US 6,247,691 B1
(45) Date of Patent: Jun. 19, 2001

(54) POSITIVE DRIVE MECHANISM FOR BUCKLE FOLDER AND METHOD

(75) Inventors: Michael R. Drago, Bethlehem; John H. Vitko, Easton, both of PA (US)

(73) Assignee: Bell & Howell Mail & Messaging Technologies Company, Durham, NC (US)

( * ) Notice: Subject to any disclaimer, the term of this patent is extended or adjusted under 35 U.S.C. 154(b) by 0 days.

(21) Appl. No.: 09/546,481

(22) Filed: Apr. 10, 2000

(51) Int. Cl.[7] ..... B42C 1/00

(52) U.S. Cl. ..... 270/45; 493/416; 493/421

(58) Field of Search ..... 270/45, 46, 58.06, 270/58.07; 493/416, 417, 419, 420, 421, 405, 424; 101/232, 216; 271/189, 299

(56) References Cited

U.S. PATENT DOCUMENTS

| | | | | |
|---|---|---|---|---|
| 2,669,331 | | 2/1954 | Dudis et al. . | |
| 3,729,186 | * | 4/1973 | Macke | 493/421 |
| 3,796,423 | | 3/1974 | Shuster . | |
| 3,797,196 | | 3/1974 | Harbison . | |
| 3,807,724 | * | 4/1974 | Bartz | 493/416 |
| 3,841,621 | | 10/1974 | Brown . | |
| 3,859,898 | * | 1/1975 | Besserdich et al. | 270/45 |
| 3,975,009 | * | 8/1976 | Brown | 493/421 |
| 4,032,133 | | 6/1977 | Steffens et al. . | |
| 4,099,710 | | 7/1978 | Boyer et al. . | |
| 4,125,254 | | 11/1978 | Boyer . | |
| 4,586,704 | | 5/1986 | Lehmann et al. . | |
| 4,616,815 | * | 10/1986 | Vijuk | 270/45 |
| 4,781,367 | | 11/1988 | Stab . | |
| 4,816,108 | * | 3/1989 | Beck et al. | 270/45 |
| 5,048,809 | | 9/1991 | Tebbe et al. . | |
| 5,082,255 | * | 1/1992 | Brigantl et al. | 270/45 |
| 5,115,918 | * | 5/1992 | De Witt et al. | 271/189 |
| 5,154,404 | * | 10/1992 | Lee Jr, et al. | 270/58.6 |
| 5,178,379 | * | 1/1993 | Edwards et al. | 271/189 |
| 5,178,383 | | 1/1993 | Moser et al. . | |
| 5,269,744 | | 12/1993 | Moll . | |
| 5,350,170 | | 9/1994 | Emigh et al. . | |
| 5,358,464 | * | 10/1994 | Funk et al. | 493/416 |
| 5,501,442 | * | 3/1996 | Mandel | 270/58.07 |
| 5,697,880 | * | 12/1997 | Auerbach | 270/45 |
| 5,701,727 | * | 12/1997 | Lundstrom et al. | 493/417 |
| 5,797,319 | | 8/1998 | Tomczak . | |
| 5,896,725 | * | 1/1999 | Lundstrom et al. | 493/416 |
| 6,004,254 | * | 12/1999 | Murata | 493/419 |

* cited by examiner

*Primary Examiner*—Eugene Eickholt
(74) *Attorney, Agent, or Firm*—Jenkins & Wilson, P.A.

(57) ABSTRACT

A positive drive mechanism for use in a sheet folding apparatus includes a motor drive, a torque-limiting device coupled to the motor drive, a drive pulley coupled to the torque-limiting device, and a plurality of idler pulleys. Each of the idler pulleys is coupled to a drive shaft which supports a fold roller. A non-slip positive drive member operatively engages portions of the drive pulley and the plurality of idler pulleys. A sheet is fed into the folder and between the fold rollers in order to fold the sheet. In the event that the sheet becomes jammed between the fold rollers, the torque-limiting device operates to release the torque transmitted from the motor drive to the drive pulley.

9 Claims, 3 Drawing Sheets

POSITIVE DRIVE MECHANISM FOR BUCKLE FOLDER AND METHOD

TECHNICAL FIELD

The present invention is relates generally to apparatuses utilized for automatically folding paper sheets, and more particularly to the drive mechanisms utilized in conjunction with such folding apparatuses.

BACKGROUND ART

Buckle folders are used to take a sheet of paper and fold it into any of a number of conventional user-selected formats, such as half or z-folds. Examples of conventional buckle folders can be found in U.S. Pat. Nos. 2,669,331; 3,796,423; 3,797,196; 3,841,621; 4,032,133; 4,099,710; 4,125,254; 4,586,704; 4,781,367; 5,048,809; 5,178,383; 5,269,744; 5,350,170; and 5,797,319 whose contents are hereby incorporated by reference into the instant patent application.

Currently, conventional buckle folders include a belt drive mechanism for transmitting rotational energy from the drive source (motor) to the various fold rollers. The belt drive used, however, is not a positive drive and after some usage, slippage occurs between the drive belt and the various drive and idler pulleys. This results in degradation in the operation of the folder.

In the past, alternative designs implementing a positive drive of some type in a folder have been proposed. For example, chain and sprocket drives have been proposed. However, chain and sprocket drives are very noisy and excessive noise is already an issue in the use of buckle folders. Also, this type of design does not incorporate a torque limiting device. Without this device, when a material jam occurs, the folder may get damaged.

Accordingly, there is room for improvement within the art.

DISCLOSURE OF THE INVENTION

In one embodiment according to the present invention, a drive mechanism is provided for use in a folder. The drive mechanism comprises a motor drive, a torque-limiting device coupled to the motor drive, a drive pulley coupled to the torque-limiting device, and a plurality of idler pulleys. Each of the idler pulleys is coupled to a drive shaft which supports a fold roller. A non-slip positive drive member operatively engages portions of the drive pulley and the plurality of idler pulleys.

The present invention also provides a method for automatically folding sheets. The method comprises the steps of providing a sheet folder including a plurality of fold rollers and providing a drive mechanism. The drive mechanism includes a motor drive, a torque-limiting device coupled to the motor drive, a drive pulley coupled to the torque-limiting device, and a plurality of idler pulleys coupled to a drive shaft supporting the fold roller. In addition, a non-slip positive drive member operatively engages portions of the drive pulley and the idler pulleys in order to positively drive the drive pulley. A sheet is fed into the folder and between the fold rollers in order to fold the sheet. In the event that the sheet becomes jammed between the fold rollers, the torque-limiting device operates to release the torque transmitted from the motor drive to the drive pulley.

Accordingly, it is an object of the invention to provide a positive drive mechanism for a buckle folder.

It is another object of the invention to provide a positive drive mechanism for a buckle folder that does not result in excessive noise.

It is a further object of the invention to provide a positive drive mechanism for a buckle folder that is better capable of handling the machine forces generated by jammed sheets.

Some of the objects of the invention having been stated hereinabove, other objects will become evident as the description proceeds when taken in connection with the accompanying drawings as best described hereinbelow.

DETAILED DESCRIPTION OF THE INVENTION

With reference to the above-mentioned figures, an example of a drive mechanism for a folder that meets and achieves the various objects of the invention set forth above will now be described.

Figure 1:
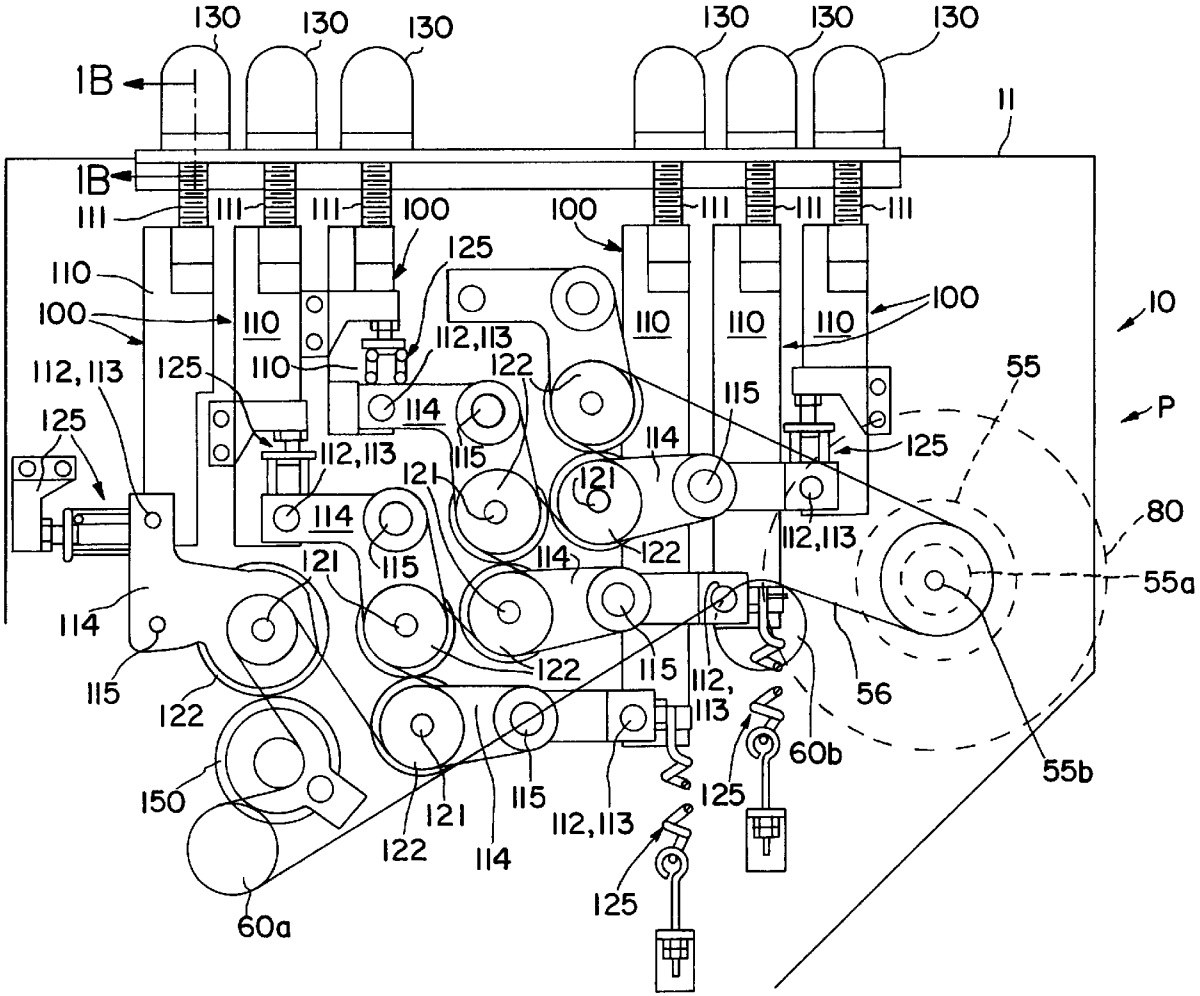
FIG. 1 PRIOR ART
FIG. 1 is an elevation view of a conventional prior art fold roller support and adjusting mechanism for a buckle folder.

FIG. 1 is an elevation view of a conventional prior art fold roller support and adjusting mechanism for a buckle folder 10 having a top support panel 11. Paper sheets are fed at a location generally indicated by arrow P.

Buckle folder 10 is provided with a plurality of fold roller support and adjusting mechanisms 100. Each folder roller will be supported at each of its ends by one of the plurality of fold roller support and adjusting mechanisms 100 (and only one is shown in the drawings herein for simplicity) so that the vertical position of each end of the fold roller can be adjusted. While each fold roller support and adjusting mechanism 100 is slightly different in design due to its position within folder 10, they all have common elements. In particular, each fold roller support and adjusting mechanism 100 includes: vertical fold roller support and adjusting bar 110 having thread portion 111 at its upper end and pivot point 112 at its lower end; pivoting roller support 114 pivotally mounted via axle 113 to pivot point 112 and pivotable about second pivot point 115; fold roller 122 rotatably mounted to pivoting roller support 114 via second axle 121; spring mechanism 125 for biasing vertical fold roller support and adjusting bar 110 in a downward position; and adjustment knobs 130 for adjusting the vertical position of vertical fold roller support and adjusting bar 110, the pivotal position of pivoting roller support 114, and therefore the position of fold roller 122.

To drive folder 10, drive pulley 55 is driven by a drive motor 55*a*, which can be conventionally positioned on drive shaft 55*b* or at various other locations based upon the manufacturer of the folder, and feeds drive forces to fold rollers 122 via drive belt 56. Take-up idler rollers 60*a*, 60*b* prevent slack in drive belt 56. A stationary exit fold roller 150 is also provided to produce an exit drive couple with the last adjustable fold roller 122. Hand wheel 80 allows a human operator to rotate all the fold rollers 122 at a slow rate and in either direction so that jammed sheets can be removed from folder 10.

Finally, it should be noted that various folder structures not relevant to the instant invention have been left out of FIG. 1 for simplicity. Examples of such conventional structures include fold plates and fold deflectors.

Competing problems are involved in conventional buckle-folders. In particular, belt slippage and folder jams are typical problems.

Belt slippage is a common problem in most belt-driven mechanical systems. Belt slippage results, from among other reasons, because of belt stretching and wear resulting from rubbing between the inner belt surface and its pulleys. To counteract or minimize the effects of belt stretching it is common to use take-up pulleys, which provide for a relatively constant tension on the belt as well as increase the amount of wrap of a belt around a pulley so as to reduce slippage. Furthermore, in some applications, belts are provided with thick rubber teeth (e.g., timing belts) that mate with similarly toothed pulleys. The belt teeth-pulley teeth interaction provides a positive drive that is less conducive to the effects of belt slippage.

However, sheet jamming can also be a pervasive problem in all sheethandling machines and especially buckle folders. Buckle folders, as can be seen in FIG. 1, provide for multiple roller gaps through which one or more sheets will simultaneously pass. Additionally, with the sheet(s) set to be both injected at high speed into one buckle-chute and then removed from the chute at a similarly high speed, precision handling is required. When this precision is deviated from, jams result.

Jams typically result in a machine "seizing" or coming to an abrupt and immediate stop as the sheet wedges itself within or around the various rollers, etc. To absorb the shock to the folder drive mechanism caused by the seizure, relative rotation/movement is allowed between the drive belt and the various pulleys, i.e., a positive drive is not used. Thus, while belt slippage is undesirable when the folder is working properly, it is desirable when a jam occurs. Slippage allows the energy produced by a machine jam to be dissipated rather than totally absorbed by the machine mechanism.

Accordingly, it can be seen that as one reduces the tendency of the belt system to slip, such as by using toothed belts and pulleys, one is also reducing the ability of the belt system to absorb the forces commensurate with a sheet jam.

The instant invention overcomes these conflicting problems by providing a positive drive system having torque-limiting capability, as will now be described.

Figure 4:
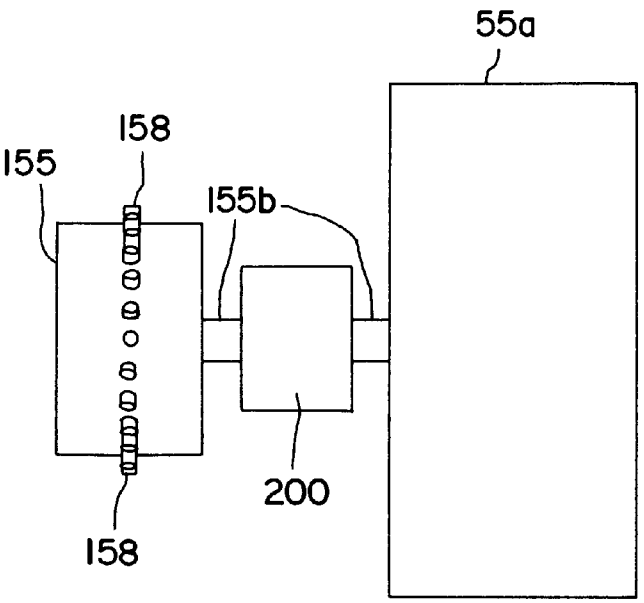
FIG. 4 is a plan view of the positive drive mechanism for a buckle folder of FIG. 3 according to the invention.

In particular, as shown in FIG. 4, a torque-limiting device 200 is added to the folder drive system between drive motor 55*a* and drive pulley 155. As a result, the drive shaft is separated into two drive shaft portions 155*b*. Torque-limiting device 200, typically in the form of a clutch of some type, is set to release the drive couple between drive motor 55*a* and drive pulley 155 when the torque reaches a predetermined limit that exceeds the normal expected torque. A suitable torque-limiting device is available from MAYR GMBH & CO. and designated as Model No. EAS-compact 01/490.520.1 S*O*.

Providing the system with torque-limiting device 200 allows a positive belt drive system to be employed. If folder 10 then jams, rather than dissipating the jam forces through slippage, the torque-limiting device releases the jam forces. Thus, there is no downside to then using a positive drive system in connection with the present invention.

While a positive drive system such as a chain and corresponding sprocket may be used, as described above, the noises resulting from the chain/sprocket interaction and the chain itself are often unacceptable. As a folder is typically already the noisiest component in a sheet handling system, additional noise is undesirable. The present invention, however, provides two alternatives to chain drive systems.

Figure 3:
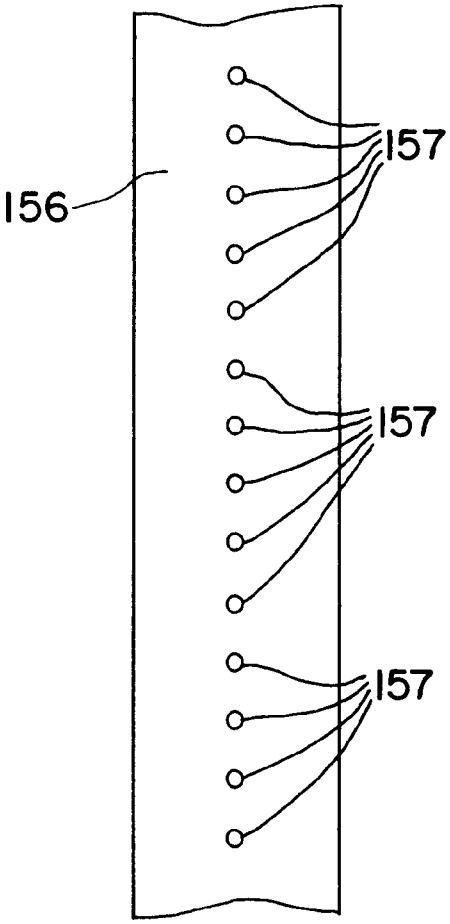
FIG. 3 is a plan view depicting a portion of the flat metal belt according to the invention.
Figure 2:
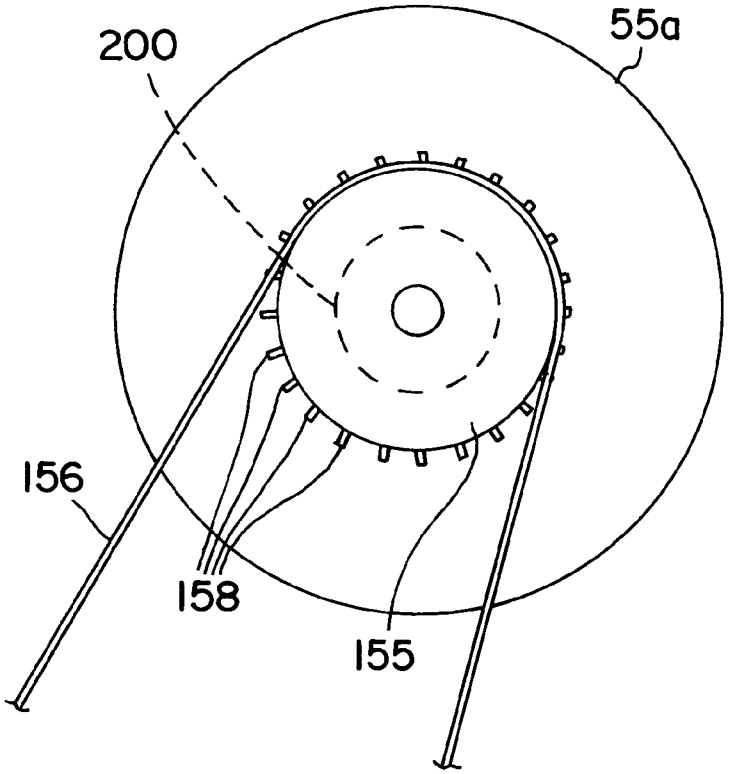
FIG. 2 is an elevation view depicting the details of a portion of the positive drive mechanism for a buckle folder according to the invention and employing a flat metal belt.

As shown in the first preferred embodiment of FIGS. 2 and 3, a flat metal belt 156 with holes 157 therein that interact with pins or teeth 158 on drive pulley 155 is preferred. Holes 157 of flat metal belt 156 interact with teeth 158 on drive pulley 155 to create the positive drive. Flat metal belt 156 is about 0.003 inches thick. Holes 157 are of 0.115 inches diameter and approximately 0.25 to 0.50 inches apart along the length of the flat metal belt 156. Pins/teeth 158 are about 0.057 inches high and spaced approximately about 0.25 to 0.50 inches apart, corresponding to the distance between holes 157 in flat metal belt 156. The belts are typically made from steel. For this embodiment, similar pulleys provided with pins/teeth 158 could then be substituted for the pulley or drum portions that support fold rollers 122, take-up idler rollers 60*a* and 60*b*, and/or exit fold roller 150 shown in FIG. 1.

Figure 5:
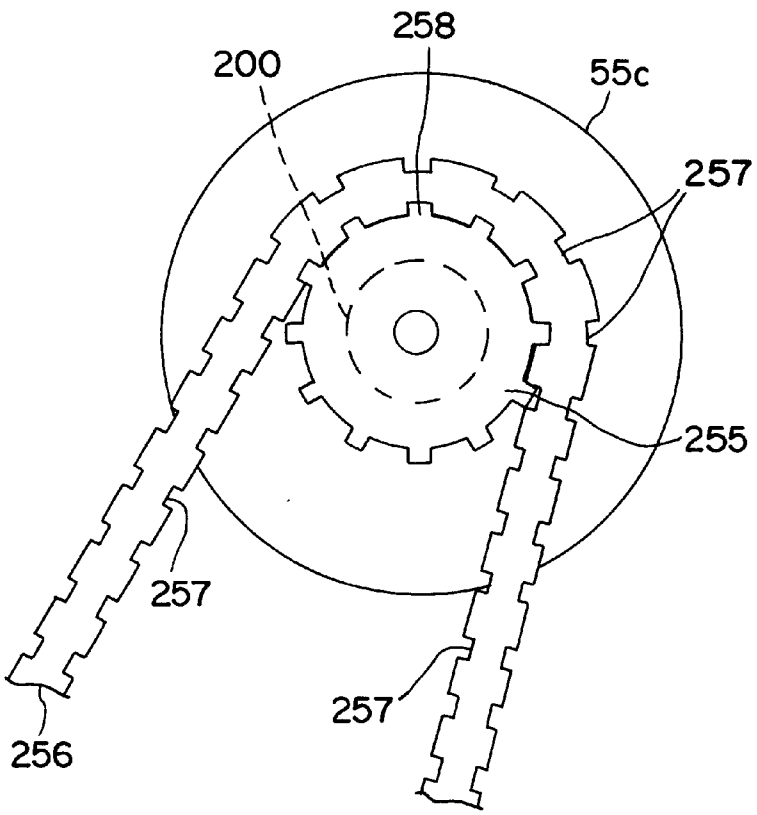
FIG. 5 is an elevation view depicting the details of a portion of the positive drive mechanism for a buckle folder according to the invention and employing a double-sided timing belt.

It is possible for flat metal belt 156 and drive pulley 155 with pins/teeth 158 to be replaced by a double-sided, notched timing belt 256 and toothed drive pulley 255, respectively, as shown in the second preferred embodiment of FIG. 5. Double-sided timing belt 256 is provided with notches 257 on both sides thereof; notches 257 mate with teeth 258 on drive pulley 255.

As in the case of flat metal belt 156, the use of double-sided timing belt 256 in conjunction with torque limiting device 200 according to the present invention represents an improvement over convention drive systems. However, observation has shown that rubber timing belts in general wear down much faster than flat metal belts and have less uniform thickness along their lengths. Accordingly, in most implementations of the present invention, the first embodiment disclosed herein incorporating flat metal belts 156 is preferred over the second embodiment incorporating double-sided timing belt 256. This is because flat metal belt 156 will in most cases be considered as allowing folder 10 to attain the degree of precision necessary for proper sheet handling and operation.

It will be understood that various details of the invention may be changed without departing from the scope of the invention. Furthermore, the foregoing description is for the purpose of illustration only, and not for the purpose of limitation—the invention being defined by the claims.

What is claimed is:

1. A drive mechanism for use in a folder comprising:

(a) motor drive;

(b) a torque-limiting device coupled to said motor drive;

(c) a drive pulley coupled to said torque-limiting device;

(d) a plurality of idler pulleys, each of said idler pulleys coupled to a drive shaft supporting a fold roller; and (e) a non-slip positive drive member operatively engaging portions of said drive pulley and said plurality of idler pulleys.

2. The drive mechanism according to claim 1 wherein said drive pulley includes a plurality of protrusions extending radially outwardly from a periphery of said drive pulley, each of said protrusions spaced equally from adjacent protrusions, and said non-slip positive drive member includes a flat belt having holes equally spaced along a length of said flat belt and adapted for operative engagement with said protrusions.

3. The drive mechanism according to claim 2 wherein each of said plurality of protrusions is a pin.

4. The drive mechanism according to claim 1 wherein each of said idler pulleys includes a plurality of protrusions extending radially outwardly from a periphery of said idler pulley, each of said protrusions spaced equally from adjacent protrusions, and said non-slip positive drive member includes a flat belt having holes equally spaced along a length of said flat belt and adapted for operative engagement with said protrusions.

5. The drive mechanism according to claim 1 wherein said drive pulley includes a plurality of drive pulley teeth extending radially outwardly from a periphery of said drive pulley and a plurality of drive pulley notches alternately disposed between adjacent drive pulley teeth, each of said drive pulley teeth spaced equally from adjacent drive pulley teeth, and said non-slip positive drive member includes a belt, the belt including a plurality of drive member teeth equally spaced along a length of said belt and adapted for operative engagement with said drive pulley notches.

6. The drive mechanism according to claim 1 wherein each of said idler pulleys includes a plurality of idler pulley teeth extending radially outwardly from a periphery of said idler pulley and a plurality of idler pulley notches alternately disposed between adjacent idler pulley teeth, each of said idler pulley teeth spaced equally from adjacent idler pulley teeth, and said non-slip positive drive member includes a belt, the belt including a plurality of drive member teeth equally spaced along a length of said belt and adapted for operative engagement with said idler pulley notches.

7. A method for automatically folding sheets comprising:

(a) providing sheet folder including a plurality of fold rollers;

(b) providing a drive mechanism including a motor drive, a torque-limiting device coupled to said motor drive, a drive pulley coupled to said torque-limiting device, a plurality of idler pulleys coupled to a drive shaft supporting said fold roller, and a non-slip positive drive member operatively engaging portions of said drive pulley and said plurality of idler pulleys to positively drive said drive pulley;

(c) feeding a sheet into said folder and causing said fold rollers to fold said sheet; and (d) using said torque-limiting device to release torque transmitted from said motor drive to said drive pulley when said sheet becomes jammed between said fold rollers.

8. The method according to claim 7 further comprising the steps of providing said drive pulley with a plurality of protrusions extending radially outwardly from a periphery of said drive pulley, each of said protrusions spaced equally from adjacent protrusions, and providing said non-slip positive drive member with a flat belt having holes equally spaced along a length of said flat belt, wherein said hole of said flat belt are adapted for operative engagement with said protrusions.

9. The method according to claim 7 further comprising the steps of providing said drive pulley with a plurality of drive pulley teeth extending radially outwardly from a periphery of said drive pulley and a plurality of drive pulley notches alternately disposed between adjacent drive pulley teeth, each of said drive pulley teeth spaced equally from adjacent drive pulley teeth, and providing said non-slip positive drive member with a belt, the belt including a plurality of drive member teeth equally spaced along a length of said belt, wherein said drive member teeth of said belt are adapted for operative engagement with said drive pulley notches.

* * * * *